US005971304A

United States Patent [19]

Sullivan

[11] Patent Number: 5,971,304

[45] Date of Patent: Oct. 26, 1999

[54] WATER DRIVEN WASTE DISPOSAL APPARATUS

[75] Inventor: Donald J. Sullivan, Sandwich, Ill.

[73] Assignee: Environmental Systems & Solutions, Inc., Draper, Utah

[21] Appl. No.: 09/123,958

[22] Filed: Jul. 29, 1998

[51] Int. Cl.[6] ..... B02C 18/42

[52] U.S. Cl. ..... 241/46.013; 241/46.04; 241/46.06; 241/46.17; 241/257.1

[58] Field of Search ..... 241/46.01, 46.013, 241/46.04, 46.06, 46.17, 100.5, 101.2, 257.1; 91/308, 318, 327, 339; 92/120, 121

[56] References Cited

U.S. PATENT DOCUMENTS

| | | | |
|---|---|---|---|
| 1,155,998 | 10/1915 | Domizi | 91/339 |
| 1,952,690 | 3/1934 | Strom, Sr. | 91/339 |
| 2,070,720 | 2/1937 | Ernst | 91/308 |
| 2,428,420 | 10/1947 | Green | 241/257.1 |
| 2,537,680 | 1/1951 | Kupiec et al. | 91/318 |
| 2,950,065 | 8/1960 | Smith et al. | 241/257.1 |
| 3,700,178 | 10/1972 | Verley . | |
| 3,788,564 | 1/1974 | Kokorzycki | 241/46.014 |
| 4,082,229 | 4/1978 | Boosman . | |
| 4,183,470 | 1/1980 | Hovartos et al. | 241/46.17 X |
| 4,399,947 | 8/1983 | Spelber et al. . | |
| 4,505,159 | 3/1985 | Spelber | 285/38 |
| 4,553,560 | 11/1985 | Tucker et al. . | |
| 4,573,642 | 3/1986 | Spelber . | |

*Primary Examiner*—John M. Husar
*Attorney, Agent, or Firm*—Thorpe, North & Western, L.L.P.

[57] ABSTRACT

A water powered waste disposal apparatus has an adjustable valve with adjustable operating pressure requirements. The disposal apparatus has a plurality of cutters disposed in a passageway for cutting waste. A reciprocating piston is driven by pressurized water in an annular chamber. The piston is coupled to at least one rotatable cutter. The valve has a reciprocating control piston for selectively diverting the pressurized water into the annular chamber on alternate sides of the drive piston. A reciprocating pilot piston selectively conveys the pressurized water to alternate sides of the control piston in response to water pressure in the annular chamber. A detent and spring apply an amount of resistance to the pilot piston such that water pressure in the annular chamber must reach a certain threshold pressure to overcome the resistance of the detent and spring. An adjustment mechanism has a threaded member engaging the spring to adjust the amount of resistance applied by the detent to the pilot piston as the threaded member is advanced and retracted.

18 Claims, 8 Drawing Sheets

WATER DRIVEN WASTE DISPOSAL APPARATUS

BACKGROUND OF THE INVENTION

1. The Field of the Invention

The present invention relates to a water powered waste disposal unit with adjustable torque and water pressure operating requirements.

2. The Background Art

Waste disposal units disposed under sinks have become commonplace. The waste disposal unit cuts or shreds waste, such as table scraps, so that the waste may pass through pipes of a house plumbing system without clogging the pipes. The disposal units provide the convenience of simply washing waste directly into the sink without having to first wipe the waste into a trash receptacle or having to later clear the waste from a drain in the sink. Disposal units are typically mounted under the sink between the drain in the bottom of the sink and the pipes of the plumbing system and typically have cutters disposed in the units and coupled to electric motors to cut the waste as it passes through the units.

Despite the conveniences provided by these waste disposal units, there are several disadvantages, one of which is the need for electrical wiring to operate the motor. Because of this, the devices are difficult to install and pose a danger of coupling an electric source to the water and plumbing system. Another disadvantage is the low starting torque of the electric motors. Waste initially disposed in the unit may stall the motor. Thus, the motor may burn out or pose a danger of injury as a user reaches into the unit to remove the clogged waste.

U.S. Pat. Nos. 3,700,178, issued Oct. 24, 1972, to Verley, and 4,082,229, issued Apr. 4, 1978, to Boosman, disclose water powered waste disposal units. The units have a housing defining an annular chamber around the unit. A reciprocating drive piston is slidingly disposed in the chamber and is coupled to a pivoting cutter in the housing. A valve alternately directs pressurized water into the annular chamber on opposite sides of the drive piston to drive the piston, and thus the cutter, in a reciprocal rotating motion.

U.S. Pat. No. 4,399,947, issued Aug. 23, 1983, to Spelber et al. discloses a valve for directing the water for a water powered disposal unit. The valve has a reciprocating control piston slidingly disposed in a valve housing. The control piston has a channel formed therein for alternately directing water into the annular chamber on either side of the drive piston as the control piston reciprocates in the valve housing. The valve also has a reciprocating pilot piston slidingly disposed in the housing. The pressure in the annular chamber forces the pilot piston to reciprocate. The pilot piston has a chamber formed therein for alternately directing water to opposite sides of the control piston as the pilot piston reciprocates, thus forcing the control piston to reciprocate.

A detent is disposed in the housing and engages the pilot piston. A spring biases the detent against the pilot piston so that the detent and spring apply an amount of resistance to the pilot piston. The water pressure developed in the annular housing must overcome the amount of resistance applied by the detent to the pilot piston in order to cause the pilot piston to reciprocate.

Despite advantages presented by the above-described water powered waste disposal units, there are also disadvantages. One is the water pressure operating requirement of the water powered units. The units require a certain amount of water pressure to initiate operation of the units. Different water sources, however, provide various different water pressures. Thus, the units may work in some areas, but not in others, depending upon the water pressure available. In addition, water pressure tends to fluctuate during the day. The pressure is lower during times of greater usage, and so the units may work at some times during the day, but not at others.

Furthermore, the water pressure operating requirements of the units result in inefficiencies. A unit designed to be used with various different water pressures, and thus lower water pressures, must have components capable of operating at lower pressures. But those same components may not be suitable to fully and efficiently utilize higher water pressures.

Another disadvantage with the water powered units is the difficulty in obtaining consistent and accurate performance characteristics from components. For example, the components applying resistance to movement of the pilot piston may apply an inconsistent amount of resistance, possibly resulting in non-functionality.

Another disadvantage of the water powered units is the high tolerances required. This is because variations in the unit dimensions and springs result in pressure variations which may or may not be sufficient to properly operate the unit. The high tolerances make the units very expensive and are difficult to obtain in less expensive, injection molded parts. These drawbacks have prevented the substantial advantages of the water powered waste disposal units from being enjoyed.

Therefore, it would be advantageous to develop a water powered waste disposal apparatus, and/or valve for such an apparatus, capable of being used with various different water pressures, including low pressures. It would also be advantageous to develop such a disposal apparatus and valve capable of efficiently utilizing the water pressure to develop the most torque. It would also be advantageous to develop such a disposal apparatus and valve capable of being manufactured inexpensively, or without excessive tolerances.

OBJECTS AND SUMMARY OF THE INVENTION

It is therefore an object of the present invention to provide a water powered waste disposal apparatus with a valve for use with various different water pressures, including low pressures.

It is another object of the present invention to provide such a water powered waste disposal apparatus with a valve for efficiently utilizing the water pressure to develop the most torque.

It is another object of the present invention to provide such a water powered waste disposal apparatus with a valve which can be manufactured inexpensively and with lower tolerances.

The above objects and others not specifically recited are realized in a specific illustrative embodiment of a water powered waste disposal apparatus with an adjustable valve for adjusting the water pressure operating requirements of the valve and torque of the apparatus. The apparatus has a housing with a waste inlet, an outlet, and a passage extending therebetween. A plurality of cutters are disposed in the passage of the housing for cutting the waste. At least one cutter is pivotally or rotationally disposed in the passageway.

The housing also defines an annular chamber formed around or circling the passage. The housing also has first and second water openings formed therein in fluid communication with the annular chamber. The first and second water openings allow water into and out of the annular chamber. A reciprocating drive piston is slidably disposed in the annular chamber and coupled to the at least one pivoting cutter to cause the pivoting cutter to pivot as the drive piston moves within the annular chamber.

The valve has a valve housing coupled to a source of pressurized water and to the first and second water openings of the housing to alternately direct the pressurized water to the first and second water openings, and thus drive the drive piston in a reciprocal manner. A reciprocating control piston is slidably disposed in the valve housing between first and second control positions. The control piston has opposite sides and an annular notch or a control channel formed therein for directing the pressurized water. As the control piston reciprocates between the first and second control positions, it alternately directs the pressurized water to the first and second openings, thus driving the drive piston in a reciprocal rotational motion.

A reciprocating pilot piston is slidably disposed in the valve housing between first and second pilot positions. The pilot piston has opposite sides and an annular notch or a pilot channel formed therein for directing the pressurized water. As the pilot piston reciprocates between the first and second pilot positions, it alternately directs the pressurized water to the opposite sides of the control piston, thus driving the control piston in a reciprocal motion.

The valve housing has first and second passageways formed therein and extending between the opposite sides of the pilot piston and the first and second openings. Water pressure is communicated from the annular chamber to the pilot piston to reciprocate the pilot piston. A detent engages the pilot piston and applies an amount of resistance to movement of the pilot piston between the first and second pilot positions. A spring may bias the detent against the pilot piston. Thus, the water pressure in the annular chamber, and thus at the opposite sides of the pilot piston, must reach a certain threshold pressure in order to overcome the amount of resistance applied by the detent and move the pilot piston.

The amount of resistance applied by the detent may be adjusted by an adjustment member. The adjustment member may movably engage the spring, thus adjusting the amount of resistance applied by the detent. Therefore, the torque of the disposal apparatus, or the at least one cutter, may be adjusted. In addition, the operating pressure requirement may be adjusted.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
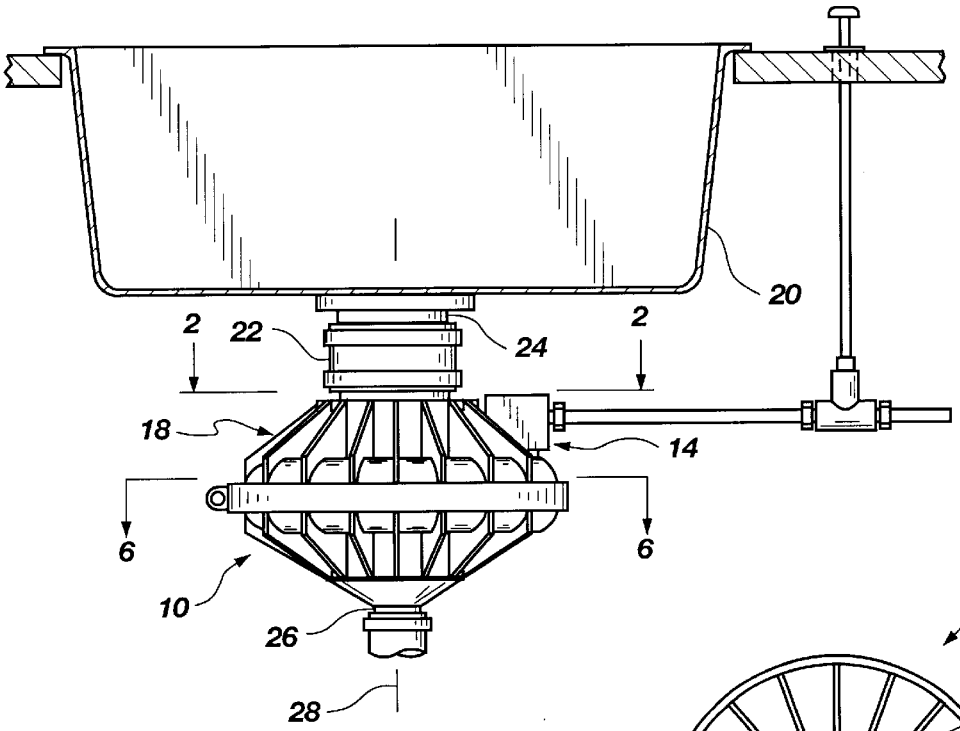
FIG. 1 is a side view of a water powered waste disposal apparatus with an adjustable valve in accordance with the principles of the present invention coupled to a sink and source of pressurized water.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Figure 2:
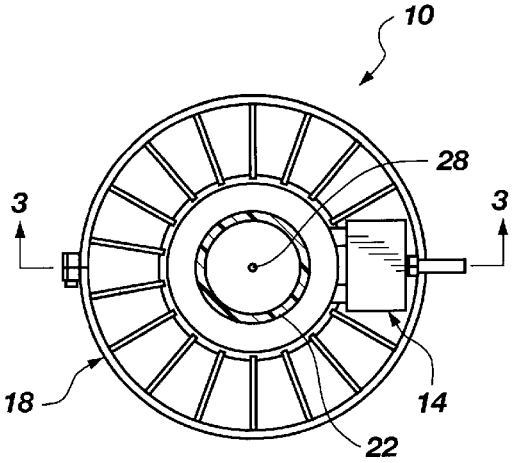
FIG. 2 is a top view of the water powered waste disposal apparatus in accordance with the principles of the present invention.
Figure 3:
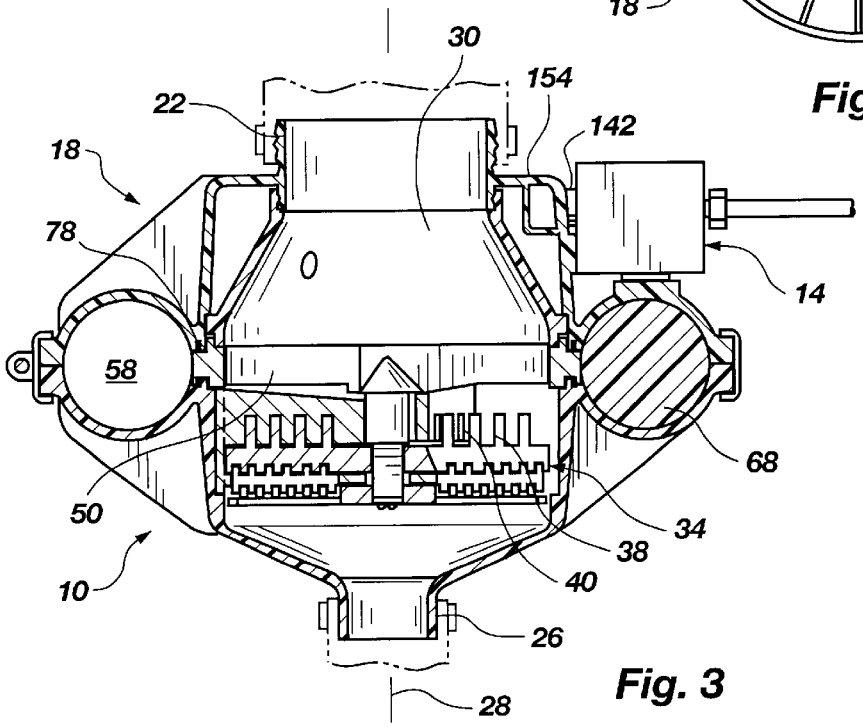
FIG. 3 is a side, cross-sectional view of the water powered waste disposal apparatus of FIG. 2, taken along section 3—3.

Referring to FIGS. 1–3, a water powered waste disposal apparatus, indicated generally at 10, with adjustable torque and water operating pressure requirements of the present invention is shown for cutting waste. In addition, an adjustable valve, indicated generally at 14, with adjustable operating pressure of the present invention is shown for directing pressurized water. The apparatus 10 has an apparatus housing 18 adapted for being disposed under a sink 20, as shown in FIG. 1. The housing 18 has a waste inlet 22 disposed generally at the top of the housing 18 for allowing the waste into the housing 18. The housing 18 and/or inlet 22 may be configured for being coupled to a drain 24 of a sink 20, as shown in FIG. 1. The housing 18 also has an outlet 26 disposed generally at the bottom of the housing 18 for allowing the waste out of the housing 18. The housing 18 may have a longitudinal axis 28 extending vertically between the inlet 22 and outlet 26.

Referring to FIG. 3, the housing 18 also defines a waste passage 30 formed in the housing 18 and extending between the waste inlet 22 and the outlet 26. The passage 30 may be concentric with the longitudinal axis 28 of the housing 18 and have a circular cross section.

Figure 4:
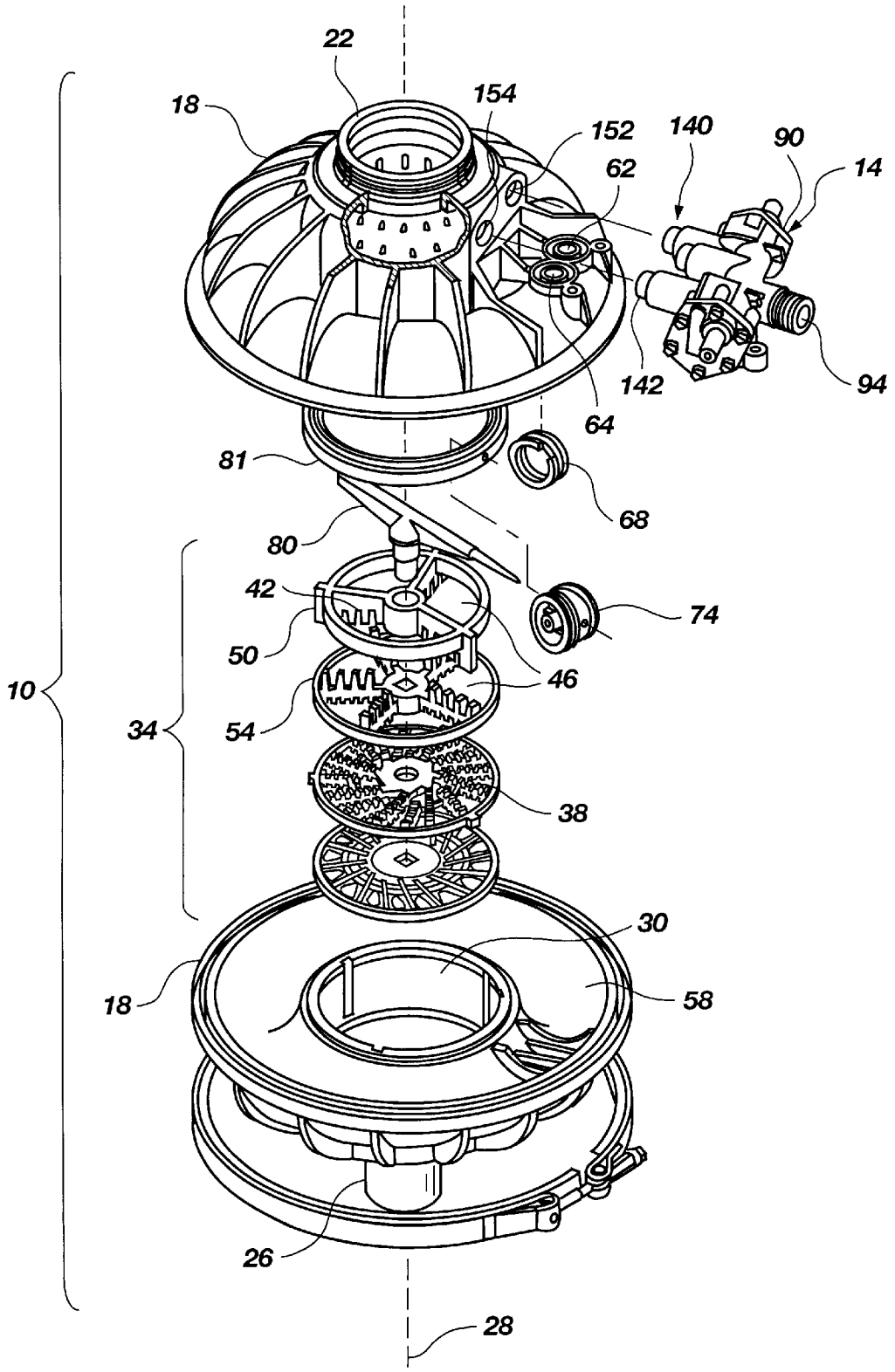
FIG. 4 is an exploded view of the water powered waste disposal apparatus in accordance with the principles of the present invention.

Referring to FIGS. 3 and 4, a plurality of cutters 34 are disposed in the passage 30. The cutters 34 may be arranged in layers, or may be stacked. The cutters 34 are preferably the same shape as the passage 30. Thus, the cutters 34 may be circular. The cutters 34 may be plates and have blades 38 or portions which protrude and interlock with grooves 42 formed in adjacent cutters 34. The cutters 34 have a plurality of openings 46 formed therein for permitting the waste to pass through the cutters 34, as shown in FIG. 4.

Some of the cutters 50 may be secured, or fixedly disposed, to the housing 18 or passage 30. At least one cutter is a pivoting cutter 54 pivotally disposed in the passage 30. The pivoting cutter 54 pivots about the longitudinal axis 28 of the housing 18. The blades 38 and grooves 42 of the adjacent cutters 50 and 54 inter-couple. As the waste passes through the openings 46 in the cutters 34, the waste is cut between the pivoting cutters 54 and the fixed cutters 50.

Figure 5A:
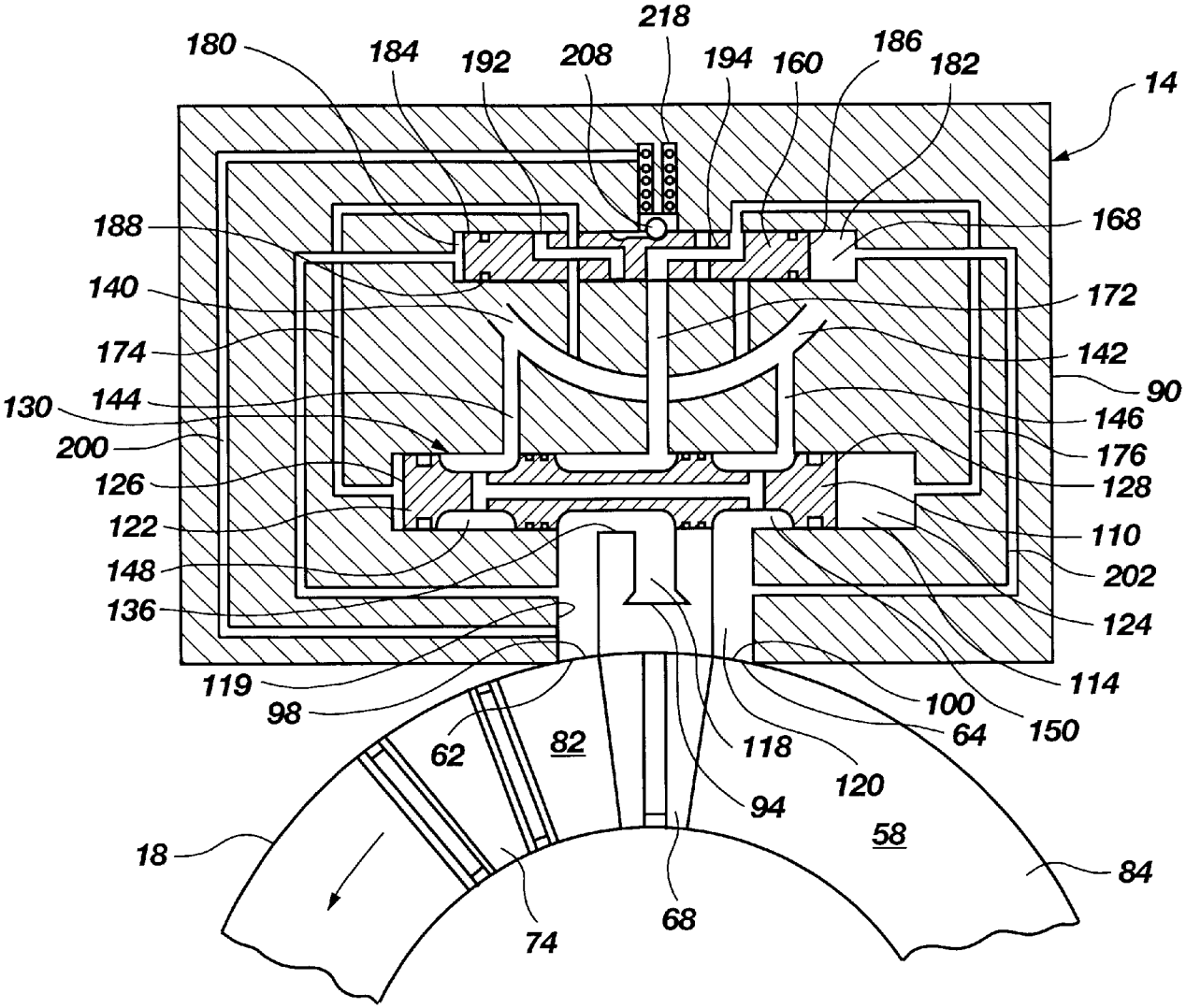
FIG. 5*a* is a schematic view of the water powered waste disposal apparatus and adjustable valve in accordance with the principles of the present invention.
Figure 5B:
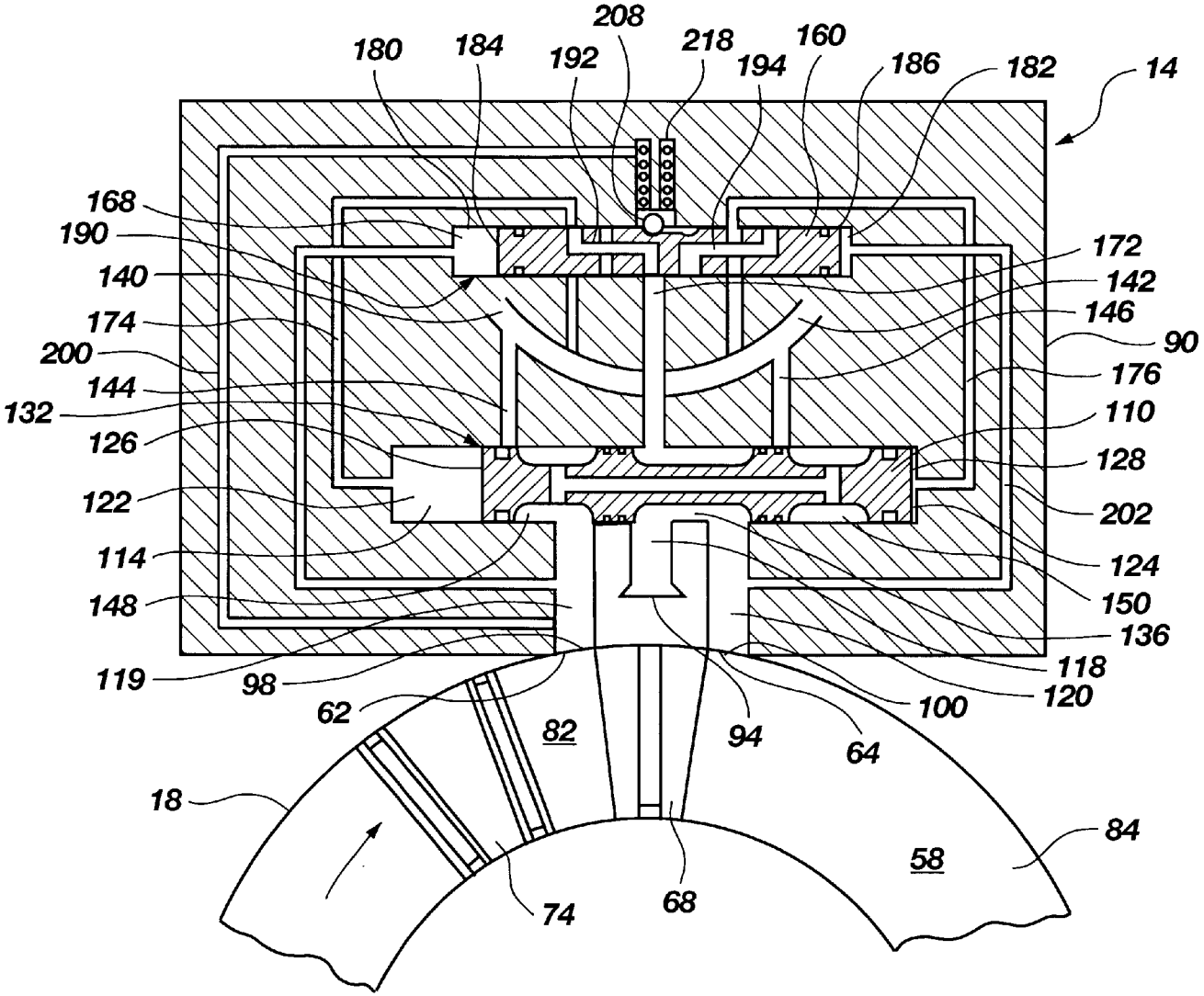
FIG. 5*b* is a schematic view of the water powered waste disposal apparatus and adjustable valve in accordance with the principles of the present invention.

Referring to FIGS. 3 and 4, the housing 18 also defines an annular chamber 58 formed about the passage 30 or the longitudinal axis 28. The annular chamber 58 has a torus or donut shape and preferably has a circular cross section. Referring to FIGS. 4, 5*a* and 5*b*, the housing 18 has first and second water openings 62 and 64, or left and right openings, formed therein which extend into the annular chamber 58. The first and second water openings 62 and 64 are located relatively close together with a small space in between them. The first and second water openings 62 and 64 allow water into, or out of, the annular chamber 58.

A plug or stop 68 is disposed in the annular chamber 58 between the first and second water openings 62 and 64, or at the small space between the first and second water openings. The water openings 62 and 64 are located relatively close to the plug 68, with one of the water openings 62 and 64 being located on one side of the plug 68. The plug 68 has the same cross section as the annular chamber 58, such as circular. In addition, the plug 68 has a perimeter or edge which seals against an inner wall of the annular chamber 58.

A reciprocating drive piston 74 is slidably disposed in the annular chamber 58. The drive piston 74 may move or slide within the annular chamber 58 in a rotational motion. The drive piston 74 has the same cross section as the annular chamber 58, such as circular. The drive piston 74 has a perimeter or edge which slidingly seals against the inner wall of the annular chamber 58.

Figure 6:
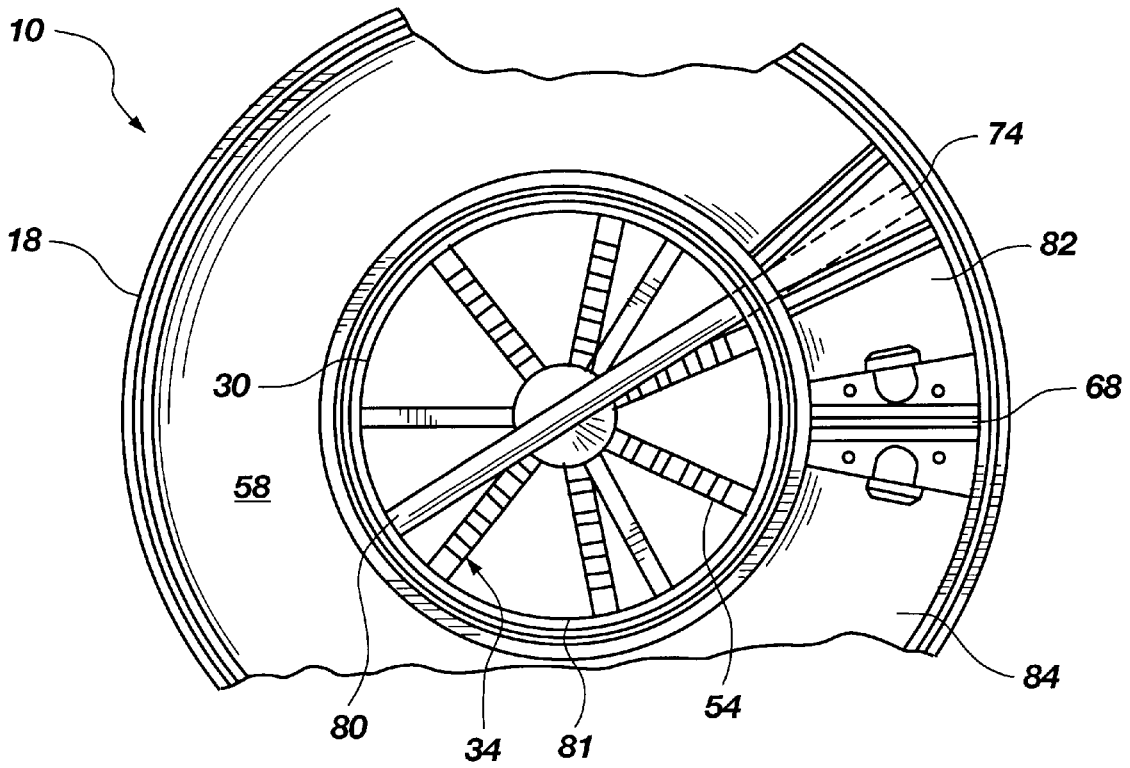
FIG. 6 is a top, cross-sectional view of the water powered waste disposal apparatus of FIG. 1, taken along section 6—6.
Figure 7:
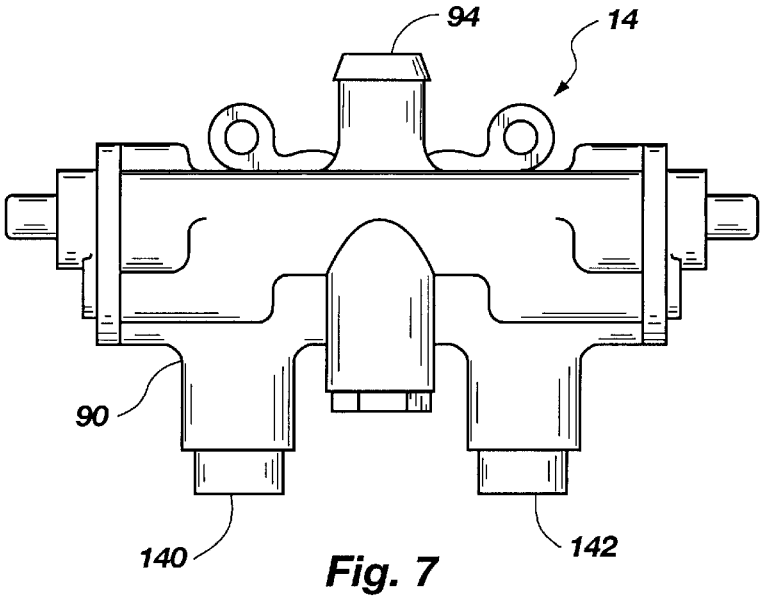
FIG. 7 is a top view of an adjustable valve in accordance with the principles of the present invention.
Figure 8:
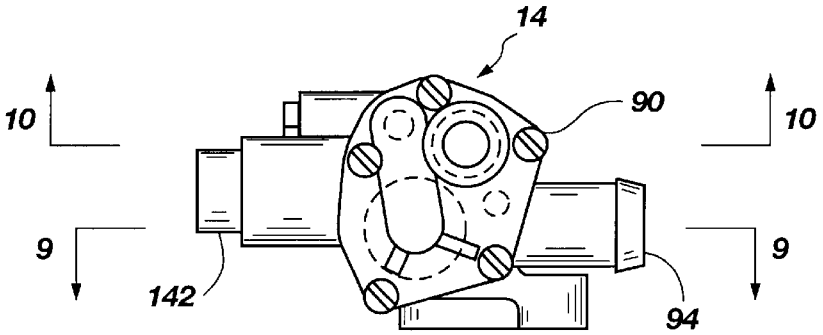
FIG. 8 is a side view of the adjustable valve in accordance with the principles of the present invention.

Referring to FIG. 6, the drive piston 74 is coupled to the pivoting cutter 54. Thus, as the drive piston 74 rotates in the annular chamber 58, it drives or forces the pivoting cutter 54 to pivot in the passage 30 of the housing 18. Referring to FIG. 3, an annular opening 78 is formed in an inner wall of the annular chamber 58 and a wall of the passage 30 so that the opening 78 extends between the passage 30 and annular chamber 58. The drive piston 74 and pivoting cutter 54 couple through the annular opening 78.

Referring to FIGS. 5*a*, 5*b* and 6, the drive piston 74 divides the annular chamber 58 into a first and second chambers 82 and 84, or left and right chambers. The first and second chambers 82 and 84 are arc-shaped, or partially annular. The first and second chambers 82 and 84 are defined by the walls of the annular chamber and the plug 68 on one end and the drive piston 74 on the other end. Thus, the first water opening 62 is formed in the first chamber 82 while the second water opening 64 is formed in the second chamber 84. The drive piston 74 has opposite sides, with one side in communication with the first chamber 82 and the other side in communication with the second chamber 84.

Referring to FIGS. 5*a* and 5*b*, the adjustable control valve 14 is advantageously coupled to the apparatus housing 18, or the first and second water openings 62 and 64. The control valve 14 supplies pressurized water from a source of pressurized water alternatively to the first and second water openings 62 and 64, and thus to first and second chambers 82 and 84, to drive the drive piston 74 in a reciprocal manner.

The adjustable valve 14 has a valve housing 90 coupled to the apparatus housing 18. The valve housing 90 has a water inlet 94 for receiving pressurized water and allowing pressurized water into the housing 90. The inlet 94 may be configured for being coupled to a pipe. Thus, the inlet 94 may have a female pipe thread formed therein. Alternatively, the inlet 94 may be configured for being coupled to tubing. Thus, the inlet 94 may have a male barb end.

The valve housing 90 also has first and second water openings 98 and 100. The first and second water openings 98 and 100 of the valve housing 90 are coupled to the first and second water openings 62 and 64 of the apparatus housing 18. The valve housing 90 defines a plurality of channels formed therein for conveying or directing the pressurized water through the housing 90 between the inlet 94 and first and second water openings 98 and 100, as discussed more fully below. The valve housing 90 also has a control cavity with opposite ends and pilot cavity with opposite ends as discussed below.

A reciprocating control piston or spool 110 is slidingly disposed in a control cavity or cylinder 114 formed in the valve housing 90. The control cavity 114 is an elongated cylinder, preferably with a circular cross section. The control cavity 114 has opposite ends. The control cavity 114 is in fluid communication with the water inlet 94 through a channel 118 formed in the housing 90. The control cavity 114 is also in fluid communication with the first and second water openings 98 and 100 through channels 119 and 120 respectively.

The control piston 110 divides the control cavity 114 into first and second control cavities 122 and 124, or left and right cavities. The control piston 110 has a first surface or side 126 in fluid communication with the first control cavity 122 and a second opposite surface or side 128 in fluid communication with the second control cavity 124. The control piston 110 is slidable between a first control position, indicated at 130 in FIG. 5*a*, and a second control position, indicated at 132 in FIG. 5*b*. For example, the control piston 110 slides left to the first control position 130 and right to the second control position 132.

The control piston 110 is an elongated member with the same cross section as the control cavity 114, such as circular. The control piston 110 has several portions with perimeters or edges that form a fluid tight seal with an inner surface of the control cavity 114. The control piston 110 has a control channel 136 or annular groove formed therein. Referring to FIG. 5*a*, the control channel 136 conveys or directs water from the water inlet 94, or channel 118, to the first water opening 98, or channel 119, when in the first control position 130. Thus, when the control piston 110 is in the first control position 130, water flows in the water inlet 94, through the channel 118, into the control cavity 114, through the control channel 136, through the channel 119, and to the first water opening 98, and thus into the first annular chamber 82. Referring to FIG. 5*b*, the control channel 136 conveys or directs water from the water inlet 94, or channel 118, to the second water opening 100, or channel 120, when in the second control position 132. Thus, when the control piston 110 is in the second control position 132, water flows in the water inlet 94, through the channel 118, into the control cavity 114, through the control channel 136, through the channel 120, and to the second water opening 100, and thus into the second annular chamber 84. Therefore, the control piston 110 and control channel 136 direct or control the flow of pressurized water to the annular chamber 58 by alternately conveying water into the first and second chambers 82 and 84.

The control channel 136 may be an annular groove formed about the longitudinal axis of the control piston 110, as shown. Alternatively, the control channel 136 may be a passage extending through the control piston 110. The control channel 136 is one example of a control channel means for conveying or directing water from the inlet 94 to the first or second openings 98 and 100. It is understood that the control channel 136 may take various forms or shapes.

In addition to conveying the pressurized water into the annular chamber 58, the control piston 110 also directs the flow of water out of the annular chamber 58. The valve housing 90 has first and second exhaust openings 140 and 142. The control cavity 114 is in fluid communication with the first and second exhaust openings 140 and 142 through channels 144 and 146 respectively.

Figure 9:
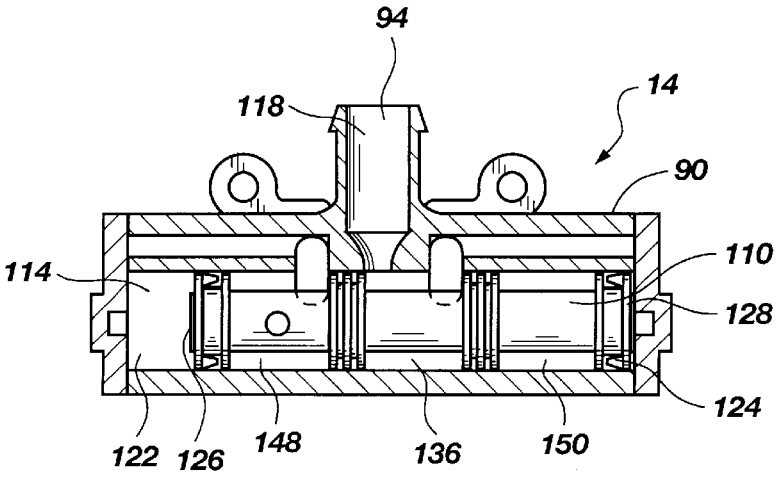
FIG. 9 is a top, cross-sectional view of the adjustable valve of FIG. 8, taken along section 9—9.

The control piston 110 also has first and second exhaust channels 148 and 150, as shown in FIG. 9, formed therein to convey water from the first and second chambers 82 and 84. The exhaust channels 148 and 150 may be annular channels formed around the control piston 110, or longitudinal axis thereof. The first and second exhaust channels 148 and 150 are located and positioned within the control piston 110 so that they alternately extend between the first and second water openings 98 and 100 and the first and second exhaust openings 140 and 142. Thus, the exhaust channels 148 and 150 may be located on either side of the control channel 136 forming annular disks or pistons therebetween for separating the channels.

While the control piston 110 is in the first control position 130 as shown in FIG. 5*a*, the second exhaust channel 150 extends between the second water opening 100 and the second exhaust opening 142 to allow water to flow out of the second chamber 84. While the control piston 110 is in the second control position 132 as shown in FIG. 5*b*, the first exhaust channel 148 extends between the first water opening 98 and the first exhaust opening 140 to allow water to flow out of the first chamber 82.

Referring to FIG. 4, the first and second exhaust openings 140 and 142 of the valve housing 90 are coupled to first and second exhaust passages 152 and 154 of the apparatus housing 18. Referring to FIG. 3, the first and second exhaust passages 152 and 154 extend through the apparatus housing 18 to the passage 30. The exhaust passages 152 and 154 preferably extend to the waste passage 30 above, or upstream, of the cutters 34. Thus, as water exhausts from the annular chamber 58, it is channeled into the passage 30 where it combines with the waste.

Referring again to FIG. 5*b*, a reciprocating pilot piston or spool 160 is slidingly disposed in a control cavity or cylinder 168 formed in the valve housing 90. The pilot piston 160 and pilot cylinder 168 are similar in many respects to the control piston 110 and control cylinder 114. The pilot cavity 168 is an elongated cylinder, preferably with a circular cross section. The pilot cavity 168 has opposite ends. The pilot cavity 168 is in fluid communication with the water inlet 94 through a channel 172 formed in the housing 90. The pilot cavity 168 is also in fluid communication with the control cavity 114, or first and second control cavities 122 and 124, through channels 174 and 176 respectively.

The pilot piston 160 divides the pilot cavity 168 into first and second pilot cavities 180 and 182, or left and right cavities. The pilot piston has a first surface or side 184 in fluid communication with the first pilot cavity 180 and a second opposite surface or side 186 in fluid communication with the second pilot cavity 182. The pilot piston 160 is slidable between a first pilot position, indicated at 188 in FIG. 5*a*, and a second pilot position, indicated at 190 in FIG. 5*b*. For example, the pilot piston 160 slides left to the first pilot position 188 and right to the second pilot position 190.

The pilot piston 160 is an elongated member with the same cross section as the pilot cavity 168, such as circular. The pilot piston 160 has several portions with perimeters or edges that form a fluid tight seal with an inner surface of the pilot cavity 168. The pilot piston 160 has first and second pilot channels 192 and 194 formed therein for conveying or directing water to the channels 174 and 176, and thus the first and second control cavities 122 and 124. Referring to FIG. 5*a*, the first pilot channel 192 conveys water from the water inlet 94, or channel 172, to the first control cavity 122 through the channel 174, when in the first pilot position 188. Thus, when the pilot piston 160 is in the first pilot position 188, water flows in the water inlet 94, through the channel 172, into the pilot cavity 168, through the first pilot channel 192, through the channel 174, and to the first control cavity 122. Referring to FIG. 5*b*, the second pilot channel 194 conveys water from the water inlet 94, or channel 172, to the second control cavity 124 through the channel 176, when in the second pilot position 190. Thus, when the pilot piston 160 is in the second pilot position 190, water flows in the water inlet 94, through the channel 172, into the pilot cavity 168, through the second pilot channel 194, through the channel 176, and to the second control cavity 124. The pressurized water in the control cavities 122 and 124 acts on the first and second surfaces 126 and 128 of the control piston 110 to force the control piston 110 into the first and second control positions 130 and 132. Therefore, the pilot piston 160 and pilot channels 192 and 194 control the position of the control piston 110 by alternately conveying water into the first and second control cavities 122 and 124.

The pilot channels 192 and 194 may be passages extending through the pilot piston 160, as shown. Alternatively, the pilot channels 192 and 194 may be annular grooves formed about the longitudinal axis of the pilot piston 160. The pilot channels 192 and 194 are examples of pilot channel means for conveying or directing water from the inlet 94 to the control cavity. Any pilot channel means may be used to direct the water. It is understood that the pilot channels may take various forms or shapes.

The valve housing 90 also has first and second pressure passages 200 and 202 formed therein for communicating pressure. The first pressure passage 200 extends between the first water opening 98 and the first pilot cavity 180 to communicate the water pressure from the first water opening 98, and thus the first chamber 82, to the first surface 126 of the pilot piston 160. Similarly, the second pressure passage 202 extends between the second water opening 100 and the second pilot cavity 182 to communicate the water pressure from the second water opening 100, and thus the second chamber 84, to the second surface 128 of the pilot piston 160. Thus, the pressure of the water at the first and second water openings 98 and 100, or the first and second chambers 82 and 84, acts on the first and second surfaces 126 and 128 of the pilot piston 160 to force the pilot piston 160 into the first and second pilot positions 188 and 190, respectively. It is understood that the pressure of the water at the water opening, and thus in the chambers, will alternate as the valve alternately directs pressurized water and exhausts the chambers.

Figure 10:
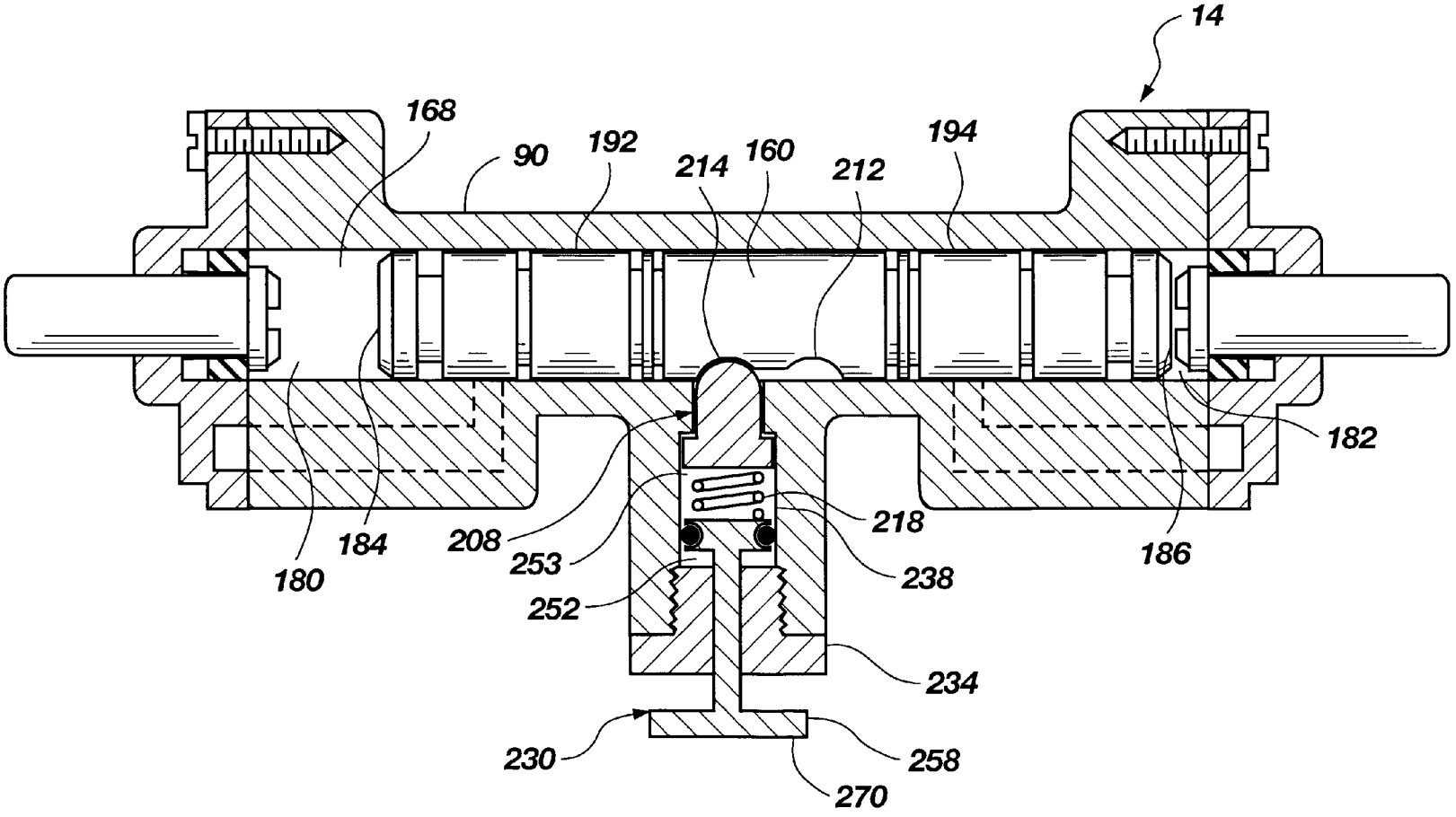
FIG. 10 is a bottom, cross-sectional view of the adjustable valve of FIG. 8, taken along section 10—10.

Referring to FIG. 10, a two-position detent 208 is disposed in or coupled to the valve housing 90 and engages one of two indentations, or first and second indentations 212 and 214, formed in the pilot piston 160. Each indentation 212 and 214 corresponds to one of the first or second pilot positions 188 and 190. For example, the detent 208 engages the first indentation 212 when the pilot piston 160 is in the first pilot position 188 and engages the second indentation 214 when in the second pilot position 190. The detent 208 may be a ball, pin, or the like.

A spring 218 is disposed in the valve housing 90 and engaging the detent 208 to bias the detent 208 into one of the two indentations 212 and 214. The detent 208 and spring 218 apply an amount of resistance to the movement of the pilot piston 160 between the first and second position 188 and 190. Thus, the water pressure acting on the first and second surfaces 184 and 186, and developed at the first and second water openings 98 and 100, must reach a certain threshold pressure to overcome the amount of resistance applied by the detent 208 and spring 218. The threshold pressure is preferably associated with the end of travel of the drive piston 74 in the annular chamber 58. It is understood that the pressurized water enters the annular chamber 58 and acts on the drive piston 74 to force the drive piston 74 to slide within the annular chamber 58 in a rotational motion. It is also understood that the pressure of the water is relatively low as the drive piston 74 moves, but increases as drive piston 74 slows or is stopped, either by the end of its travel or by waste lodging between the fixed and pivoting cutters 50 and 54.

In prior art devices, the difficulties in obtaining springs with consistent properties and the variations in available water pressure posed operation problems. For example, some springs may apply too great a resistance to the pilot piston while others apply too little resistance. If too much resistance is applied to the pilot piston, the water pressure will not be able to reciprocate the pilot piston. If too little resistance is applied to the pilot piston, waste which should be cut by the cutters will instead lodge in the cutters and cause the pilot piston to reciprocate prematurely. As another example, some areas have little water pressure or water pressure that varies. Thus, a device that works well in one area may not work in another because the low pressure may not be able to overcome the resistance applied by the spring.

The spring 218 is one example of a biasing means for biasing the detent 208 against the pilot piston 160. Any biasing means for biasing the detent 208 may be used, including for example, a resilient member, fluid pressure, etc.

Referring to FIG. 10, the valve 14 of the present invention advantageously has an adjustor 230 or adjustment mechanism for adjusting the amount of resistance applied by the spring 218 and detent 208 to the pilot piston 160. By adjusting the amount of resistance applied by the spring 218 and detent 208, the valve 14, and the apparatus 10, may be adjusted to suit the water pressure available. In addition, the valve 14 and the apparatus 10 may be adjusted to compensate for the different properties of different springs, or to compensate for wear of the springs. Furthermore, the valve 14 and apparatus 10 may be adjusted to obtain the desired torque or cutting power. Therefore, the valve 14 and apparatus 10 of the present invention are more efficient than prior art devices and may operate with any number of environmental conditions.

In the preferred embodiment of the present invention, the adjustor 230 is adapted to adjust the resistance applied by the spring 218 biasing the detent 208 against the pilot piston 160. The adjustor 230 preferably adjusts the resistance by adjusting the bias force applied by the spring 218 to the detent 208. The adjustment advantageously is accomplished by varying the amount of compression of the spring 218, or by varying the length of a cavity in which the spring is disposed.

Figure 11:
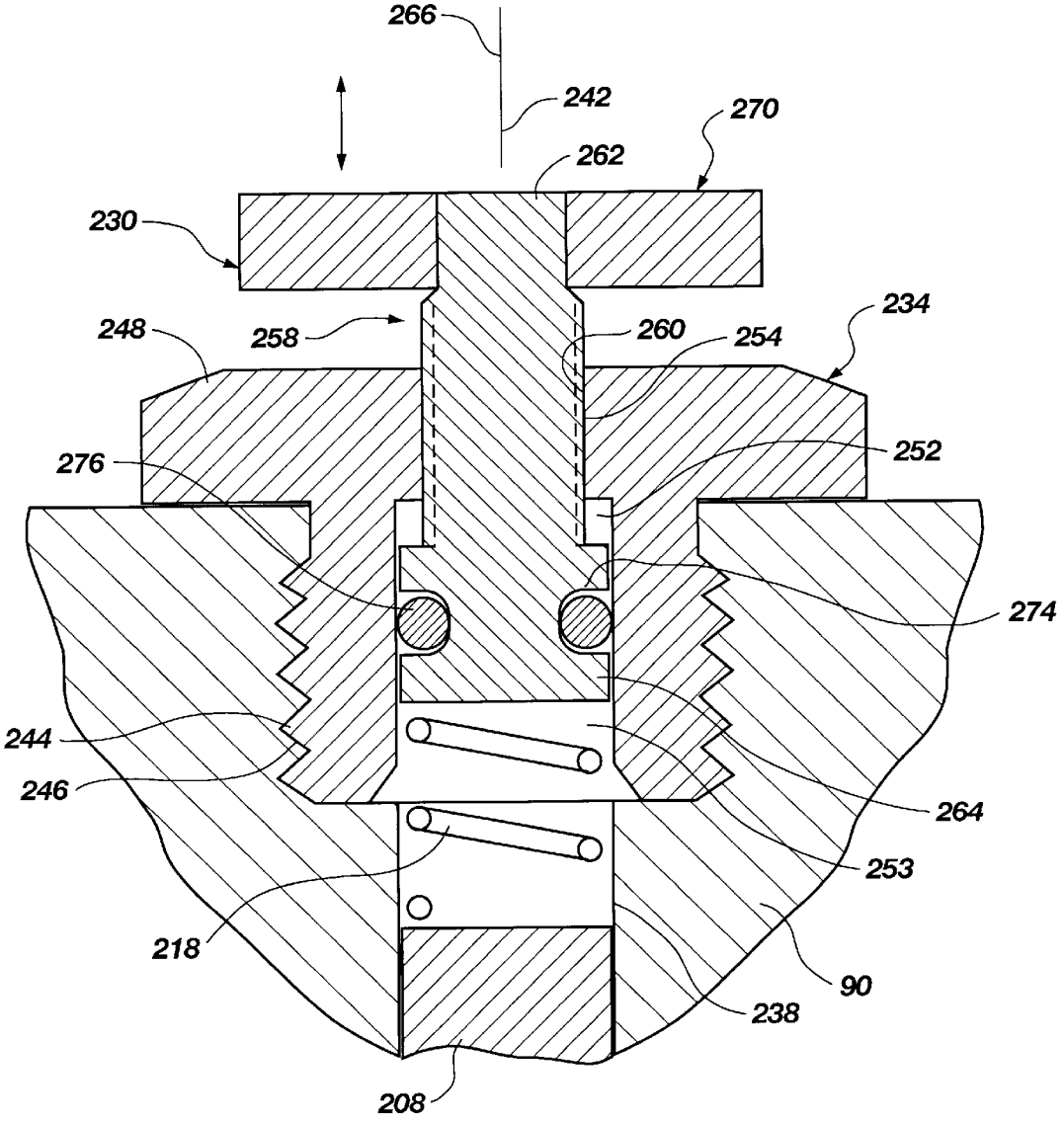
FIG. 11 is a detailed view of an adjustment mechanism of the adjustable valve of FIG. 10.

Referring to FIG. 11, the adjustor 230 has a body 234 coupled to the valve housing 90. The body 234 may be disposed in a bore 238 formed in the housing 90 adjacent or proximate the spring 218 and detent 208, and thus the pilot piston 160 and pilot cavity 168. The body 234 may be somewhat elongated and may have a longitudinal axis 242. The body 234 may have threads 244 formed on a portion of an exterior surface thereof which engage threads 246 formed on an inner surface of the bore 238, such that the body 234 may be threaded into the bore 238 and secured to the housing 90. The body 234 may also have a head 248 configured for being engaged by a tool to secure the body 234 to the housing 90. The body 234 may be hollow, or have a hole 252 formed therein extending along the longitudinal axis 242 all the way through the body 234. The hole 252 may form a portion of a spring cavity 253 in which the spring 218 is partially disposed. The hole 252 may also have threads 254 formed on an inner surface thereof.

The adjustor 230 also has an adjustment member or threaded member 258 disposed in the hole 252. The adjustment member 258 may have threads 260 threadedly engaging the threads 254 of the hole 252, and thus engaging the housing 90. The adjustor 230 may be an elongated member having a proximal end 262 and a distal end 264, and a longitudinal axis 266. The proximal end 262 has a knob 270 formed thereon to enable a user to engage and turn the adjustment member 258. The distal end 264 has an annular groove 274 for receiving a seal or o-ring 276. The seal 276 seals between a surface of the adjustment member 258 and an inner surface of the hole 252 of the body 230 so that water may not leak from the hole 252. The distal end 264 may also be enlarged so that it abuts a reduced section of the hole 252 in the body 234 to prevent the adjuster 230 from being completely removed, or unthreaded, from the body 234, and thus the valve housing 90.

The distal end 264 engages the spring 218. The distal end 264 also forms a displaceable end of the spring cavity 253. Because the adjustment member 258 threadedly engages the body 234, and thus the housing 90, turning the adjustment member 258, or the knob 270, advances and retracts the adjustable member 258 from the body 234, or the housing 90. As the adjustable member 258 advances and retracts, the distal end 264 also advances and retracts from the hole 252, thus decreasing and increasing the length of the spring cavity 253 and the amount of compression of the spring 218. As the length of the spring cavity 253 varies, so does the amount of biasing force applied to the detent 208 by the spring 218. Therefore, by turning the knob 270 of the adjuster 230, the valve 14 may be adjusted for differences in water pressure or spring properties.

The adjustor 230 and threaded member 258 are examples of adjustment means for adjusting the amount of resistance applied by the detent 208 and/or spring 218. Any adjustment means for adjusting the amount of resistance may be used, including for example, a bleed screw for reducing fluid pressure, a screw for adjusting a resilient member, etc.

In operation, the apparatus 10 is disposed under a sink 20 and the valve 14 coupled to a source of pressurized water as discussed above, as shown in FIG. 1. Reference will now be made to FIG. 5*a*. Assume that the initial status of the valve 14 is with the control piston 110 in the first control position 130, or to the left of the control cavity 114, and the pilot piston 160 is in the first pilot position 188, or to the left of the pilot cavity 168. In addition, assume the detent 208 is engaging the second indentation 214 of the pilot piston.

The pressurized water enters the valve housing 90 through the water inlet 94. The pressurized water enters the control cavity 114 where it is directed by the control piston 110 out of the first water opening 98 in the valve housing 90, but into the first water opening 62 of the apparatus housing 18. The pressurized water enters the first chamber 82 of the annular chamber 58 where it acts on the drive piston 74 to force the drive piston 74 to slide or move within the annular chamber 58 in a rotational motion, or counter-clockwise.

In addition, any water in the second chamber 84 of the annular chamber 58, or exhaust water, is forced out through the second water opening 64 of the apparatus housing 18, but into the second water opening 100 of the valve housing 90, by the drive piston 74. The exhaust water enters the control cavity 114 where it is directed by the control piston 110 out of the second exhaust opening 142 and into the waste passage 30.

Meanwhile, the pressurized water also enters the pilot cavity 168. The pilot piston 160 directs the pressurized water into the second cavity 124 of the control cavity 114. The pressurized water acts on the second surface 128 of the control piston 110 to force the control piston 110 to the first control position 130, or to the left.

In addition, the pressure of the water at the first water opening 98 of the valve housing 90, and thus at the first chamber 62, is communicated by the first pressure passage 200 to the first cavity 180 of the pilot cavity 168. The water pressure acts against the first surface 184 of the pilot piston 160. Initially, the spring 218 biases the detent 208 against the second indentation 214, maintaining the pilot piston 160 in the first pilot position 188 despite the force of the water. Eventually, however, the pressurized water in the first chamber 62 forces the drive piston 74 through the length of the annular chamber where it abuts the plug 68, defining an end of travel. As the drive piston 74 stops moving, water pressure builds up in the first chamber 62 and is communicated to the first pilot cavity 180. The water pressure now reaches a certain threshold amount in which it acts against the pilot piston 160 with enough force to overcome the amount of resistance applied by the spring 218 and detent 208. The water pressure now forces the pilot piston 160 into the second pilot position 190, or to the right of the pilot cavity 168.

Reference will now be made to FIG. 5*b*, with the pilot piston 160 in the second pilot position 190, the pressurized water enters the pilot cavity 168 where it is directed by the pilot piston 160 to the first cavity 122 of the control cavity 114. The pressurized water acts against the first surface 126 of the control piston to force the control piston into the second control position 132, or to the right of the control cavity 114.

With the control piston 110 in the second control position 132, the pressurized water enters the control cavity 114 where it is directed by the control piston 110 out of the second water opening 100 in the valve housing 90, but into the second water opening 64 of the apparatus housing 18. The pressurized water enters the second chamber 84 of the annular chamber 58 where it acts on the drive piston 74 to force the drive piston 74 to slide or move within the annular chamber 58 in a rotation motion, or clockwise.

In addition, any water in the first chamber 82 of the annular chamber 58, or exhaust water, is forced out through the first water opening 62 of the apparatus housing 18, but into the first water opening 98 of the valve housing 90, by the drive piston 74. The exhaust water enters the control cavity 114 where it is directed by the control piston 110 out of the first exhaust opening 140 and into the waste passage 30.

The pressure of the water at the second water opening 100 of the valve housing 90, and thus at the second chamber 64, is communicated by the second pressure passage 202 to the second cavity 182 of the pilot cavity 168. The water pressure acts against the second surface 186 of the pilot piston 160. Initially, the spring 218 biases the detent 208 against the first indentation 212, maintaining the pilot piston 160 in the second pilot position 190 despite the force of the water. Eventually, however, the pressurized water in the second chamber 64 forces the drive piston 74 through the length of the annular chamber where it abuts the plug 68, defining an end of travel. As the drive piston 74 stops moving, water pressure builds up in the second chamber 64 and is communicated to the second pilot cavity 182. The water pressure now reaches a certain threshold amount in which it acts against the pilot piston 160 with enough force to overcome the amount of resistance applied by the spring 218 and detent 208. The water pressure now forces the pilot piston 160 into the first pilot position 188, or to the left of the pilot cavity 168.

This process repeats causing the drive piston 74 to reciprocate in the annular chamber 58, and thus causing the pivoting cutter 54 to reciprocate in a rotational or pivotal motion. The pressure in the annular chamber 58 causes the pilot piston 160 to shift back and forth, which in turn causes the control piston 110 to shift back and forth, which in turn causes the drive piston 74 to reciprocate.

The adjustor 230 may be used to adjust the threshold water pressure required to shift the pilot piston 160, and thus shift the control piston 110 and reciprocate the drive piston 74 and cutter 54. In addition, the adjustor 230 may be used to adjust the torque or rotational force exerted by the drive piston 74 and cutter 54. By advancing and retracting the threaded member 258, the amount of compression of the spring 218 is adjusted, and thus the amount of biasing force exerted by the spring 218 is adjusted.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An adjustable valve for directing pressurized water, comprising:

a valve housing having an inlet for receiving the pressurized water, first and second openings for allowing the water out of the housing, a control cavity having opposing ends, a pilot cavity having opposing ends, and water channel means for conveying the pressurized water through the housing;

a reciprocating control piston slidably disposed between the opposing ends of the control cavity, the control piston having control channel means formed therein for conveying water from the inlet to either the first or second openings depending on the location of the control piston in the control cavity;

a reciprocating pilot piston slidably disposed between the opposing ends of the pilot cavity, the pilot piston having pilot channel means formed therein for conveying water from the inlet to either of the opposing ends of the control cavity to control the location of the control piston;

the water channel means including passageways formed in the housing extending between the first and second openings and the pilot cavity so that the fluid pressure at the first and second openings acts to force the pilot piston alternatively to the opposing ends of the pilot cavity;

resistance means coupled to the housing and engaging the pilot piston for applying an amount of resistance to movement of the pilot piston between the opposing ends of the pilot cavity such that the fluid pressure at the first and second openings must reach a threshold pressure in order to overcome the amount of resistance applied by the resistence means to the pilot piston;

adjustment means for adjusting the amount of resistance applied by the resistance means, to thereby adjust the operating pressure of the valve.

2. The valve of claim 1, wherein the resistance means comprises two indentations formed in the pilot piston, a detent engaging one of the two indentations, and biasing means for biasing the detent into one of the two indentations.

3. The valve of claim 2, wherein the biasing means comprises a spring, and wherein the adjustment means comprises an adjustment member engaging the valve housing and moveably engaging the spring such that the adjustment member advances and retracts from the housing, and thus compresses and relieves the spring, to thereby adjust the amount of resistance of the detent.

4. The device of claim 2, wherein the biasing means comprises a spring, and wherein the adjustment means comprises a threaded member threadedly engaging the valve housing and engaging the spring such that turning the threaded member advances and retracts the threaded member from the housing, and thus compresses and relieves the spring, to thereby adjust the amount of resistance of the detent.

5. An adjustable valve for a water driven waste disposal apparatus driven by pressurized water and having a reciprocating drive piston slidably disposed in an annular drive chamber and coupled to cutting means for cutting waste, the annular chamber having first and second water openings formed therein on opposite sides of the drive piston, the valve comprising:

a valve housing having an inlet for receiving the pressurized water, first and second openings for coupling to the first and second water openings of the annular chamber respectively, a control cavity with opposite ends, a pilot cavity with opposite ends, and channel means for conveying the pressurized water through the housing from the inlet to the control and pilot cavities, from the control cavity to the first and second openings, and from the pilot cavity to the control cavity;

a reciprocating control piston slidably disposed in the control cavity between a first and a second control positions, the control piston dividing the control cavity into first and second control cavities, the control piston having a first surface in communication with the first cavity and a second surface in communication with the second cavity, the control piston having control channel means formed therein for (i) conveying water from the inlet to the first water opening when in the first position, and (ii) conveying water from the inlet to the second water opening when in the second position;

a reciprocating pilot piston slidably disposed in the pilot cavity between first and second pilot positions, the pilot piston dividing the pilot cavity into first and second pilot cavities, the pilot piston having a first surface in communication with the first cavity and a second surface in communication with the second cavity, the pilot piston having pilot channel means formed therein for (i) conveying water from the inlet to the second control cavity when in the first pilot position to force the control piston into the first control position, and (ii) conveying water from the inlet to the first control cavity when in the second pilot position to force the control piston into the second control position;

the water channel means including first and second passageways formed in the housing, the first passageway extending between the first opening and the first pilot cavity so that the water pressure acts on the first surface of the pilot piston to force the pilot piston into the second pilot position, the second passageway extending between the second opening and the second pilot cavity so that the water pressure acts on the second surface of the pilot piston to force the pilot piston into the first position;

resistance means disposed in the housing and engaging the pilot piston for applying an amount of resistance to the movement of the pilot piston between the first and second pilot positions such that water pressure at the first and second openings must reach a threshold pressure in order to overcome the amount of resistance applied by the resistence means to the pilot piston;

adjustment means for adjusting the amount of resistance applied by the resistance means.

6. The valve of claim 5, wherein the resistance means comprises two indentations formed in the pilot piston, a detent engaging one of the two indentations, and biasing means for biasing the detent into one of the two indentations.

7. The valve of claim 6, wherein the biasing means comprises a spring, and wherein the adjustment means comprises an adjustment member engaging the valve housing and moveably engaging the spring such that the adjustment member advances and retracts from the housing, and thus compresses and relieves the spring, to thereby adjust the amount of resistance of the detent.

8. The valve of claim 6, wherein the biasing means comprises a spring, and wherein the adjustment means comprises a threaded member threadedly engaging the valve housing and engaging the spring such that turning the threaded member advances and retracts the threaded member from the housing, and thus compresses and relieves the spring, to thereby adjust the amount of resistance of the detent.

9. The valve of claim 5, wherein the valve housing further comprises first and second exhaust openings formed therein in fluid communication with the control cavity; and wherein the control piston has a first exhaust channel formed therein for conveying water from the first water opening to the first exhaust opening when in the second control position, and a second exhaust channel formed therein for conveying water from the second water opening to the second exhaust opening when in the first control position.

10. A water powered waste disposal apparatus, comprising:

a housing having a waste inlet, an outlet, a passage extending therebetween, and an annular chamber formed about the passage and having a first and second water openings formed therein and extending into the annular chamber;

at least one pivoting cutter pivotally disposed in the passage for cutting the waste;

a reciprocal drive piston slidably disposed in the annular chamber and coupled to the at least one pivoting cutter, the drive piston having opposite sides;

a control valve for supplying water alternately to the first and second water openings to drive the drive piston, and thus the at least one cutter, in a reciprocating rotational motion, the control valve having an inlet for receiving the water and first and second openings coupled to the first and second water openings of the housing;

a reciprocating control piston slidably disposed in the valve and having opposite sides and control channel means formed therein for directing water from the inlet to the first or second openings, and thus the opposite sides of the drive piston;

a reciprocating pilot piston slideably disposed in the valve and having opposite sides and pilot channel means formed therein for alternately directing water from the inlet to the opposite sides of the control piston to cause the control piston to reciprocate;

the valve having passageways formed therein and extending from the first and second water openings to the opposite sides of the pilot piston for communicating water pressure from the annular chamber to the pilot piston to reciprocate the pilot piston;

resistance means engaging the pilot piston for applying an amount of resistance to the movement of the pilot piston such that water pressure at the first and second openings must reach a threshold pressure in order to overcome the amount of resistance applied by the resistence means to the pilot piston;

adjustment means for adjusting the amount of resistance applied by the resistance means.

11. The disposal apparatus of claim 10, wherein the resistance means comprises two indentations formed in the pilot piston, a detent engaging one of the two indentations, and a biasing means for biasing the detent into one of the two indentations.

12. The disposal apparatus of claim 11, wherein the biasing means comprises a spring, and wherein the adjustment means comprises an adjustment member engaging the valve housing and moveably engaging the spring such that the adjustment member advances and retracts from the housing, and thus compresses and relieves the spring, to thereby adjust the amount of resistance of the detent.

13. The disposal apparatus of claim 11, wherein the biasing means comprises a spring, wherein the adjustment means comprises a threaded member threadedly engaging the valve housing and engaging the spring such that turning the threaded member advances and retracts the threaded member from the housing, and thus compresses and relieves the spring, to thereby adjust the amount of resistance of the detent.

14. The disposal apparatus of claim 10, wherein the valve further comprises first and second exhaust openings formed therein in fluid communication with the control cavity; and wherein the control piston has a first exhaust channel formed therein for conveying water from the first water opening to the first exhaust opening when in the second control position, and a second exhaust channel formed therein for conveying water from the second water opening to the second exhaust opening when in the first control position.

15. A water powered waste disposal apparatus, comprising:

a housing having a waste inlet, an outlet, a passage extending therebetween, and an annular chamber formed about the passage and having a first and second water openings formed therein in fluid communication with the annular chamber;

cutting means disposed in the passage of the housing for cutting the waste and including at least one pivoting cutter pivotally disposed in the passage;

a drive piston slidably disposed in the annular chamber and dividing the annular chamber into first and second chambers, the at least one pivoting cutter being coupled to the drive piston, the drive piston having first and second sides;

a plug disposed in the annular housing between the first and second water openings;

a control valve for supplying water alternately to the first and second chambers to drive the drive piston, and thus the at least one cutter, in a reciprocating rotational motion, the control valve having an inlet for receiving the water, and first and second openings coupled to the first and second openings of the housing;

a reciprocating control piston slidably disposed in the valve and having opposite sides and control channel means formed therein for alternately directing water from the inlet to the first and second opening;

a reciprocating pilot piston slidably disposed in the valve and having opposite sides and pilot channel means formed therein for alternately directing water from the inlet to opposite sides of the control piston to cause the control piston to reciprocate;

the valve having passageways formed therein and extending from the first and second water openings to opposite sides of the pilot piston for communicating water pressure from the annular housing to the pilot piston to reciprocate the pilot piston;

resistance means engaging the pilot piston for applying an amount of resistance to the movement of the pilot piston such that water pressure at the first and second openings must reach a threshold pressure in order to overcome the amount of resistance applied by the resistence means to the pilot piston;

adjustment means for adjusting the amount of resistance applied by the resistance means.

16. The disposal apparatus of claim 15, wherein the resistance means comprises two indentations formed in the pilot piston, a detent engaging one of two indentations, and biasing means for biasing the detent into one of the two indentations.

17. The disposal apparatus of claim 16, wherein the biasing means is a spring, and wherein the adjustment means comprises an adjustment member engaging the valve housing and moveably engaging the spring such that the adjustment member advances and retracts from the housing, and thus compresses and relieves the spring, to thereby adjust the amount of resistance of the detent.

18. The disposal apparatus of claim 16, wherein the biasing means is a spring, and wherein the adjustment means comprises a threaded member threadedly engaging the valve housing and engaging the spring such that turning the threaded member advances and retracts the threaded member from the housing, and thus compresses and relieves the spring, to thereby adjust the amount of resistance of the detent.

* * * * *